US008811876B2

(12) United States Patent
Endo et al.

(10) Patent No.: US 8,811,876 B2
(45) Date of Patent: Aug. 19, 2014

(54) IMAGE HEATING APPARATUS

(71) Applicant: Canon Kabushiki Kaisha, Tokyo (JP)

(72) Inventors: Terutaka Endo, Odawara (JP); Michio Uchida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 31 days.

(21) Appl. No.: 13/712,255

(22) Filed: Dec. 12, 2012

(65) Prior Publication Data

US 2013/0164057 A1 Jun. 27, 2013

(30) Foreign Application Priority Data

Dec. 27, 2011 (JP) ..... 2011-285621

(51) Int. Cl.
*G03G 15/20* (2006.01)

(52) U.S. Cl.
USPC ..... 399/329; 219/216

(58) Field of Classification Search
USPC ..... 399/329; 219/216
See application file for complete search history.

(56) References Cited

U.S. PATENT DOCUMENTS

| | | | | |
|---|---|---|---|---|
| 5,860,052 | A * | 1/1999 | Ohtsuka et al. | 399/329 |
| 7,177,579 | B2 | 2/2007 | Uchida et al. | |
| 7,235,761 | B1 * | 6/2007 | Maul et al. | 219/216 |
| 7,269,365 | B2 * | 9/2007 | Mochizuki et al. | 399/33 |
| 7,283,780 | B2 | 10/2007 | Uchida et al. | |
| 7,366,455 | B2 | 4/2008 | Iwasaki et al. | |
| 7,512,370 | B2 | 3/2009 | Shimizu et al. | |
| 7,865,120 | B2 | 1/2011 | Suzuki et al. | |
| 8,229,338 | B2 | 7/2012 | Nanataki et al. | |
| 2002/0011476 | A1 * | 1/2002 | Otsuka | 219/216 |
| 2006/0045589 | A1 | 3/2006 | Iwasaki et al. | |
| 2007/0116481 | A1 * | 5/2007 | Mochizuki et al. | 399/33 |
| 2012/0230742 | A1 | 9/2012 | Nakagawa et al. | |
| 2013/0136515 | A1 * | 5/2013 | Sahara | 399/329 |

FOREIGN PATENT DOCUMENTS

| | | | |
|---|---|---|---|
| JP | 11-016667 | A | 1/1999 |
| JP | 2000-188170 | A | 7/2000 |
| JP | 2006-071894 | A | 3/2006 |
| JP | 2007-102010 | A | 4/2007 |

* cited by examiner

*Primary Examiner* — G. M. Hyder
(74) *Attorney, Agent, or Firm* — Fitzpatrick, Cella, Harper & Scinto

(57) ABSTRACT

The image heating apparatus includes an endless belt, a heater placed in contact with an inner surface of the endless belt, a holder made of resin, adapted to hold the heater, and provided with a supporting space to be fitted with the heater, where a through hole is formed in a heater receiving surface of the holder at a bottom area of the supporting space; and a back-up member adapted to form a nip together with the heater to pinch and convey a recording material through the endless belt. In the bottom area, hollow portions recessed from the bottom area are provided at opposite ends in a short direction of the holder, being located at locations in a longitudinal direction of the holder different from a location in which the through hole is formed. Consequently, even if the heater heats up abnormally, heater cracks can be prevented.

6 Claims, 6 Drawing Sheets

IMAGE HEATING APPARATUS

BACKGROUND OF THE INVENTION

1. Field of the Invention

The present invention relates to an image heating apparatus suitable for use as a fixing apparatus mounted on an electrophotographic copier or electrophotographic printer.

2. Description of the Related Art

As a fixing apparatus mounted on an electrophotographic copier or electrophotographic printer, a fixing apparatus of a film heating type is known. The fixing apparatus of the film heating type includes a heater which is made up of a resistive heating member mounted on a ceramic substrate, a cylindrical fixing film which moves in contact with the heater, and a pressure roller which forms a nip together with the heater, pinching the fixing film. A recording material carrying an unfixed toner image is heated while being pinched and conveyed at the nip, and consequently the image on the recording material is heat-fixed to the recording material by heat.

The fixing apparatus of this type has the advantage that the time required for the heater to heat up to a fixing range after the heater is turned on is short. Therefore, the printer equipped with the fixing apparatus can reduce the time required to output the first image after a print order is input (FPOT: First Print Out Time). Also, the printer has the advantage of being able to reduce power consumption while waiting on standby for a print order.

Incidentally, in the fixing apparatus described above, the operating temperature of the heater and a pressing force applied to the nip are further increased to meet market demands for higher product specifications such as improved throughput and increased image gloss. When the operating temperature of the heater or the pressing force is increased, if the temperature becomes uncontrollable due to a failure of a temperature control circuit, heater cracks could develop before a protective element, such as a thermoswitch or thermal fuse, which cuts off power supply to the heater, comes into operation. This is because when the temperature control circuit fails, the heater becomes very hot, causing a heater holder (made of resin material) which holds the heater to start melting, and if a heater holding seat surface of the heater holder melts nonuniformly in a longitudinal direction orthogonal to a recording material conveyance direction, stresses are applied to the heater by concentrating on part of the heater.

Japanese Patent Application Laid-Open No. 2007-102010 discloses a technique whereby a seat surface of the heater holder is ingeniously shaped such that a protective element will come into operation before a heater is broken.

The heater holder is provided with holes for use to dispose a temperature-measuring element such as a thermistor and a protective element, such as a thermoswitch or thermal fuse, where the temperature-measuring element measures the temperature of the heater and the protective element cuts off power supply to the heater when the heater becomes abnormally hot due to a failure of a temperature control circuit. Through the holes in the heater holder, the temperature-measuring element and protective element abut a rear surface of the heater (surface opposite to that surface of the heater which faces the nip) at an appropriate pressure. Incidentally, hole portions in the heater holder provide air layers, i.e., heat insulating layers. There are gaps around the temperature-measuring element and the protective element inserted in the hole portions, and the gaps serve as heat insulating portions. Therefore, when abnormal heat is generated by the heater, heat tends to build up around the heat insulating portions, causing the heater holder to melt faster. On the other hand, portions away from the hole portions of the holder melt later than the hole portions. Consequently, it has become clear that the hole portions, on which stresses are concentrated, are subject to a shearing force, resulting in heater cracks.

SUMMARY OF THE INVENTION

An object of the present invention is to provide an image heating apparatus which can prevent heater cracks even if a heater heats up abnormally.

Another object of the present invention is to provide an image heating apparatus which can buy time for a protective element to come into operation in time to prevent heater cracks even if the heater heats up abnormally.

A further object of the present invention is to provide an image heating apparatus for heating an image formed on a recording material, including an endless belt, a heater configured to be in contact with an inner surface of the endless belt, a holder made of resin and configured to hold the heater, the holder having a supporting space in which the heater is engaged, where at least one or more through holes are formed in a bottom area of the supporting space, and a back-up member configured to form a nip together with the heater to pinch and convey the recording material through the endless belt, wherein the bottom area includes one or more hollow portions recessed from the bottom area, at both ends in a short direction of the holder and at a location/locations in which the at least one or more through holes do not exist in a longitudinal direction of the holder.

A still further object of the present invention will become apparent from the following detailed description in reference with the accompanying drawings.

DESCRIPTION OF THE EMBODIMENTS

Preferred embodiments of the present invention will now be described in detail in accordance with the accompanying drawings.

First Embodiment (1) Example of Image Forming Apparatus

Figure 7:
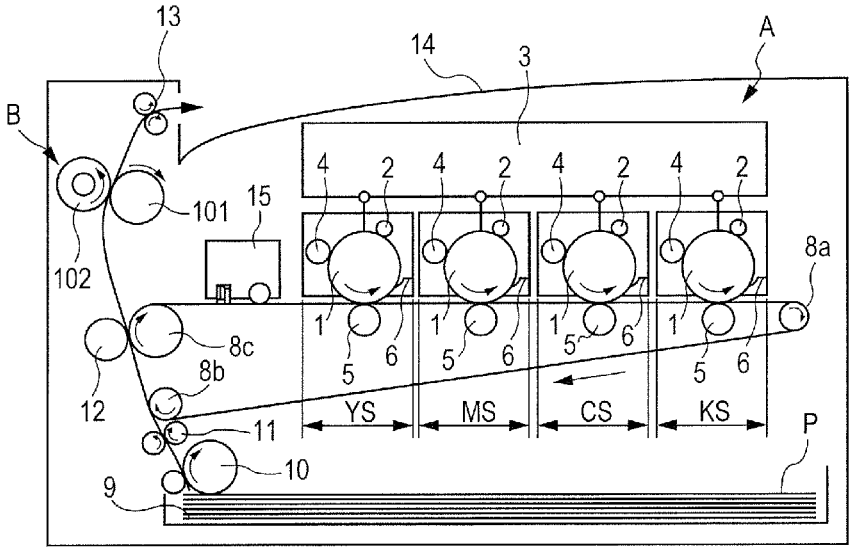
FIG. 7 is a schematic configuration diagram showing an example of an image forming apparatus.

FIG. 7 is a schematic configuration diagram showing an example of an image forming apparatus which can be equipped with an image heating apparatus according to the present invention as a fixing apparatus. The image forming apparatus is a full-color laser printer adapted to form images on a recording material such as recording sheets or OHP sheets using electrophotographic technology.

The image forming apparatus according to the present embodiment includes an image forming section A adapted to form unfixed toner images on a recording material P, and a fixing section (fixing apparatus) B adapted to heat-fix the unfixed toner images on the recording material P. The image forming section A includes four image forming stations YS, MS, CS and KS.

Of the four image forming stations YS, MS, CS and KS, the image forming station YS forms yellow-colored (hereinafter abbreviated to Y) images, the image forming station MS forms magenta-colored (hereinafter abbreviated to M) images, the image forming station CS forms cyan-colored (hereinafter abbreviated to C) images, and the image forming station KS forms black-colored (hereinafter abbreviated to K) images. Each of the image forming stations YS, MS, CS and KS includes a drum-shaped electrophotographic photosensitive body (hereinafter referred to as a photosensitive drum) 1 serving as an image bearing member, and a charge roller 2 serving as a charge unit. Also, each of the image forming stations YS, MS, CS and KS also includes an exposing apparatus 3 as an exposing unit, a developing apparatus 4 as a developing unit, a primary transfer roller 5 as a primary transfer member, and a drum cleaner 6 as a cleaning unit.

In the image forming apparatus according to the present embodiment, the photosensitive drum 1 of the image forming station YS is rotated in the direction of the arrow in response to a print order. The photosensitive drum 1 is configured such that first an outer circumferential surface (front surface) of the photosensitive drum 1 is uniformly charged to a predetermined potential with predetermined polarity by the charge roller 2 (charging process). Then, as the exposing apparatus 3 irradiates a charged surface on the front surface of the photosensitive drum 1 with a laser beam based on image information (image data) accepted as input from an external apparatus, the charged surface on the front surface of the photosensitive drum 1 is exposed, forming an electrostatic latent image (electrostatic image) (exposing process). The latent image is visualized as a Y toner image by the developing apparatus 4 using Y toner. Consequently, the Y toner image is formed on the front surface of the photosensitive drum 1 (developing process).

Similar image forming processes including a charging process, exposing process and developing process are performed at the image forming stations MS, CS and KS. Consequently, an M toner image, C toner image and K toner image are formed on the front surfaces of the photosensitive drums 1 at the image forming stations MS, CS and KS, respectively.

An endless, intermediate transfer belt 7 installed along an arrangement direction of the image forming stations YS, MS, CS and KS is looped over a driving roller 8*a*, a driven roller 8*b* and a secondary transfer counter roller 8*c*. The intermediate transfer belt 7 is rotated in the direction of the arrow along each of the image forming stations YS, MS, CS and KS at a predetermined peripheral speed by the driving roller 8*a*. The toner images of respective colors are transferred one on top of another to an outer circumferential surface (front surface) of the intermediate transfer belt 7 by the primary transfer rollers 5 disposed on the opposite side of the intermediate transfer belt 7 from the photosensitive drums 1 (primary transfer process). Consequently, a full four-color unfixed toner image is carried by the front surface of the intermediate transfer belt 7. Residual toner remaining on the front surfaces of the photosensitive drums 1 after the primary transfer is removed by the drum cleaners 6 to prepare the photosensitive drums 1 for next image formation operation.

On the other hand, the recording material P stored in a feed cassette 9 installed below the intermediate transfer belt 7 is separated and fed sheet by sheet from the feed cassette 9 by a feed roller 10 and then fed to a registration roller pair 11. The registration roller pair 11 sends out the recording material P, which has been fed, to a secondary transfer nip between the secondary transfer counter roller 8*c* and a secondary transfer roller 12 disposed facing each other across the intermediate transfer belt 7. The recording material P is pinched and conveyed in the secondary transfer nip by the front surface of the intermediate transfer belt 7 and outer circumferential surface (front surface) of the secondary transfer counter roller 8*c*. In the course of conveyance, the unfixed toner image on the front surface of the intermediate transfer belt 7 is transferred onto the recording material by the secondary transfer roller 12 and consequently carried by the recording material (secondary transfer process).

The recording material P carrying the unfixed toner image is introduced into a fixing nip (nip) N of the fixing apparatus B. By passing through the fixing nip N, the unfixed toner image is heat-fixed to the recording material under heat and pressure. The recording material P is conveyed from the fixing apparatus B to a discharge roller 13 and discharged onto a discharge tray 14 by the discharge roller 13.

Residual toner remaining on the intermediate transfer belt 7 after the secondary transfer is removed by a belt cleaner 15 serving as an image conveyor member cleaning unit. Consequently, the intermediate transfer belt 7 becomes ready for next image formation.

(2) Fixing Apparatus B

Figure 1:
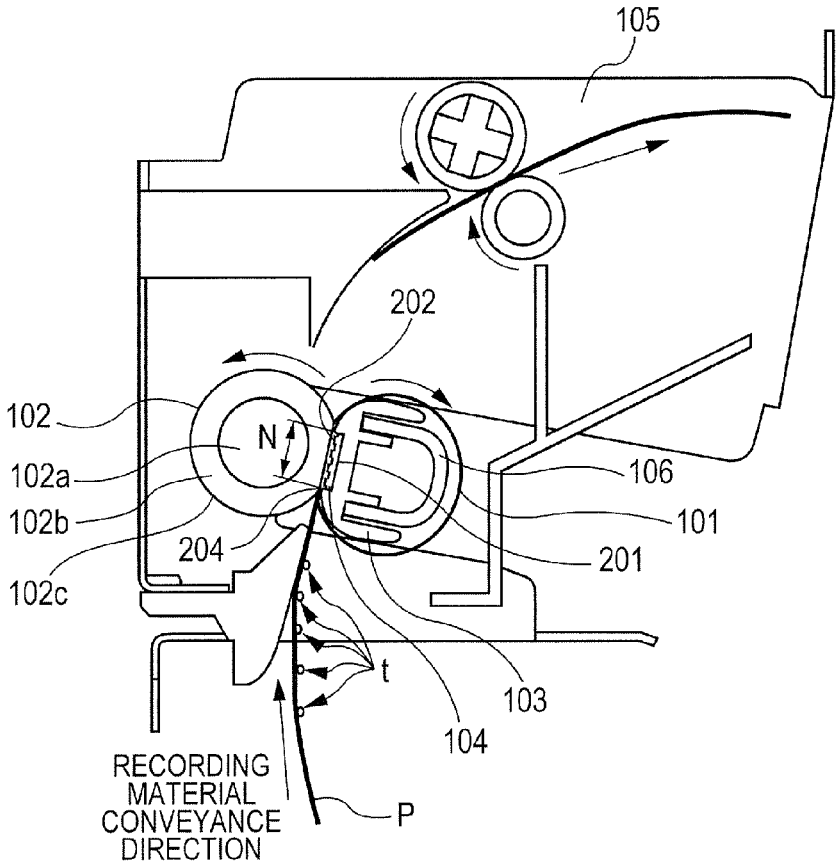
FIG. 1 is a cross-sectional side view showing a configuration of a fixing apparatus according to a first embodiment.
Figure 2:
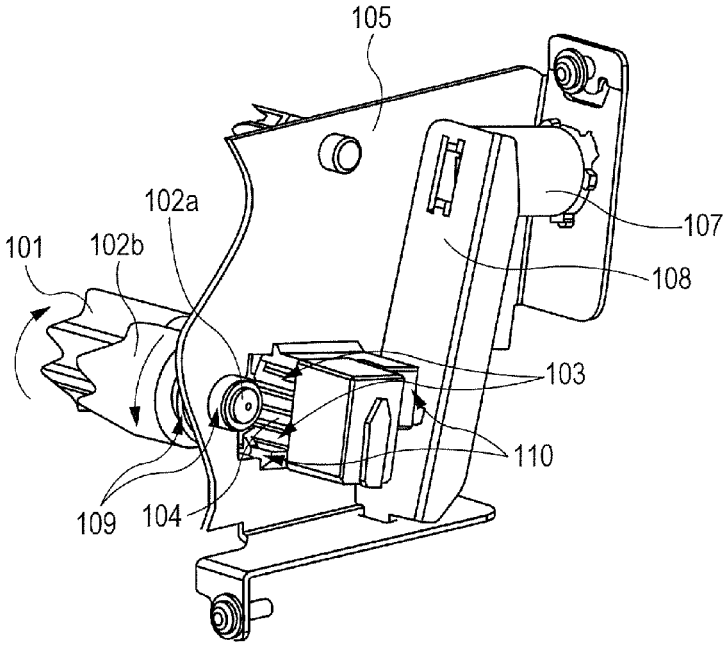
FIG. 2 is an explanatory diagram illustrating a pressure mechanism and a rotational driving mechanism of the fixing apparatus according to the first embodiment.
Figure 3:
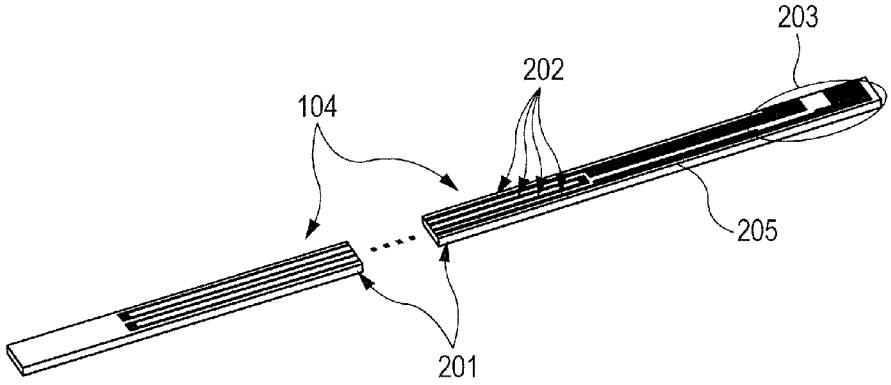
FIG. 3 is a perspective view of a heater with a protective layer removed.

FIG. 1 is a cross-sectional side view showing a configuration of the fixing apparatus B. FIG. 2 is an explanatory diagram of a pressure mechanism and rotational driving mechanism located on the left side of the fixing apparatus B as viewed along a recording material conveyance direction. FIG. 3 is a perspective view of a heater 104 with a protective layer 204 removed. The fixing apparatus B is of a film heating type. Although not illustrated, a pressure mechanism and rotational driving mechanism located on the right side of the fixing apparatus B have the same configuration as the pressure mechanism and rotational driving mechanism shown in FIG. 2.

1) Overall Configuration of Fixing Apparatus B

The fixing apparatus B according to the present embodiment is roughly divided into a heater assembly and a pressure roller 102 serving as a back-up member.

The heater assembly includes a fixing film 101 which is a cylindrical member (shaped like an endless belt) provided with an elastic layer in a film-like member. A heater holder 103 serving as a support member has heat resistance and rigidity. The heater holder 103 is formed in the shape of a trough substantially semicircular in cross section so as to be able to support the heater 104 and guide rotation of a fixing belt 101. The heater holder 103 is required to ensure heat resistance and insulation and have structural strength. Also, it is important for the heater holder 103 to have formability. Thus, engineering plastic reinforced by glass fiber is often used for heater holder 103, where examples of engineering plastic include LCP (Liquid Crystal Polymer) material made of wholly aromatic polyester resin or the like.

The heater 104 serving as a heating element is placed and disposed so as to be embedded in a supporting space S of the heater holder 103. A pressure stay 106 serving as a pressure member is placed in parallel to a longitudinal direction of the heater holder 103 in an area on the opposite side of the heater holder 103 from the side on which the heater is placed. The fixing film 101 is fitted loosely over the heater holder 103.

All of the fixing film 101, the pressure roller 102, the heater holder 103, the heater 104, and the pressure stay 106 are members elongated in the direction orthogonal to the recording material conveyance direction.

2) Heater 104

As shown in FIG. 3, the heater 104 has a ceramic substrate (hereinafter referred to as a substrate) 201 made of aluminum oxide (alumina) or aluminum nitride. A resistive heating member layer 202 (solid area in FIG. 3) is formed on a front surface (a surface on the side of the fixing nip N) of the substrate 201. To form the resistive heating member layer 202, a film of a conductive paste containing silver-palladium alloy is applied at a uniform thickness by a screen printing method, followed by baking. The resistive heating member layer 202 generates heat by the passage of electric current, wherein the thickness of the resistive heating member layer is approximately 10 μm and the width of the heating layer ranges approximately 1 to 5 mm.

Also, on the front surface (the surface on the side of the fixing nip N) of the substrate 201, first and second electrodes 203 and an extension electric circuit 205 are formed inside a left end portion in the longitudinal direction, where the first and second electrodes 203 and extension electric circuit 205 are intended for use as a feed pattern for the resistive heating member layer 202 and made of a silver paste by a technique, such as screen printing, which is followed by baking.

To protect, and ensure insulation of, the resistive heating member layer 202 and the extension electric circuit 205, a glass coat of pressure-resistant glass or a polyimide coat 206 (see FIG. 4C) is formed as a protective layer 204 on the resistive heating member layer 202 and the extension electric circuit 205. The glass coat or polyimide coat 206 is approximately 10 μm thick and can be resistant to friction with the fixing film 101.

3) Fixing Film 101

The fixing film 101 uses an endless film approximately 50 to 65 μm in thickness as a base layer, where the endless film is made of polyimide resin or metal such as Ni or stainless steel formed into a cylindrical shape. Then, a silicone rubber layer is formed as an elastic layer on the endless film by a ring coating method. Furthermore, top of the silicone rubber layer is coated with a PFA resin tube approximately 30 μm to 50 μm thick.

4) Pressure Roller 102

The pressure roller 102 is made by forming a silicone rubber layer (elastic layer) 102*b* approximately 3.5 mm in thickness on an outer circumferential surface of a core bar 102*a* of stainless steel by injection molding and by coating the top of the silicone rubber layer with a PFA resin tube (releasing layer) 102*c* approximately 40 μm in thickness. The pressure roller 102 has opposite ends of the core bar 102*a* in the longitudinal direction held by bearings 109 disposed on left and right of a frame 105. The heater assembly is disposed such that the pressure roller 102 and the heater 104 face each other across the fixing film 101.

The heater assembly is pressed using the pressure stay 106 and left and right flanges 110 as power points, where the pressure stay 106 is disposed parallel to the heater holder 103 while the left and right flanges 110 are guided by the frame 105 by holding the pressure stay 106. Furthermore, the left and right flanges 110 are urged in a direction perpendicular to an axis of the pressure roller 102 by a pressure mechanism which includes left and right metal pressure plates 108 and left and right pressure springs 107, where the left and right metal pressure plates 108 use a portion pushed into the frame 105 as a fulcrum based on the principle of the lever while the left and right pressure springs 107 apply pressure to the left and right metal pressure plates 108. According to the present embodiment, the flanges 110 are pressed at 102.9 N (10.5 kgf) each for a total pressure of 205.8 N (21 kgf).

The pressure mechanism configured as described above achieves a predetermined pushing force (pressing force) using the fixing film 101 and pressure roller 102 which form the fixing nip (nip) N of a predetermined width required to heat-fix the unheated, unfixed toner image carried by the recording material P. That is, the heater 104 held to the heater holder 103 by the pressing force of the pressure mechanism is pressed against the pressure roller 102 through the fixing film 101. Consequently, the elastic layer 102*b* of the pressure roller 102 elastically deforms, forming the fixing nip N of a predetermined width between the outer circumferential surface (front surface) of the fixing film 101 and outer circumferential surface (front surface) of the pressure roller 102. The width here means a dimension in a direction (short direction) parallel to the recording material conveyance direction. In this way, the pressure roller 102 forms the fixing nip N together with the heater 104, pinching the fixing film 101.

5) Heat-Fixing Operation of Fixing Apparatus B

When a drive motor (not shown) is rotationally driven in response to a print order, the pressure roller 102 is rotated counterclockwise, as indicated by an arrow (see FIG. 1), at a predetermined peripheral speed by a rotational driving force of the drive motor. The rotation of the pressure roller 102 is transmitted to the fixing film 101 in the fixing nip N by means of a frictional force against a front surface of the fixing film 101. Consequently, the fixing film 101 rotates (moves) clockwise, as indicated by an arrow (see FIG. 1), along an outer circumference of the heater holder 103 by following the rotation of the pressure roller 102 while an inner circumferential surface (inner surface) of the fixing film 101 slides along the protective layer 204 (described later) of the heater 104. The inner surface of the fixing film 101 is coated with heat resistant grease (lubricant) to ensure slidability of an inner surface of the fixing belt 101 along the heater 104 and heater holder 103.

Also, when a print order is input, a temperature control circuit (not shown) operates a heater drive circuit (not shown) so that power will be supplied to the heater 104 from a commercial power source. Consequently, power is supplied to the resistive heating member layer 202 through the first and second electrodes 203 and extension electric circuit 205 of the heater 104. As a result, with the resistive heating member layer 202 heating up rapidly, the heater 104 heats the fixing film 101. The temperature of the heater 104 is detected by a temperature-measuring element (not shown) such as a thermistor disposed on a rear surface of the substrate 201 (surface opposite to the side of the fixing nip N). Based on an output signal from the temperature-measuring element, the temperature control circuit determines a duty ratio and wave number of a voltage to be applied to the resistive heating member layer 202 and maintains the temperature of the fixing nip N at a predetermined fixing temperature (target temperature) through appropriate control.

With the drive motor being driven rotationally and with the resistive heating member layer 202 of the heater 104 remaining on, the recording material P carrying an unfixed toner image t is introduced into the fixing nip N. In the fixing nip N, a toner image bearing side of the recording material P is placed in close contact with the front surface of the fixing film 101 and the recording material P is pinched and conveyed through the fixing nip N together with the fixing film 101. In the course of conveyance, heat is transferred from the heater 104 to the recording material P through the fixing film 101, heating and pressing the toner image t on the recording material P and thereby heat-fixing the toner image t to the recording material. The recording material P with the toner image t heat-fixed thereto is separated from the front surface of the fixing film 101 and discharged from the fixing nip N.

6) Stress Concentration Prevention Structure for Heater 104 (Shape of Heater Holding Seat Surface of Heater Holder)

Figure 4A:
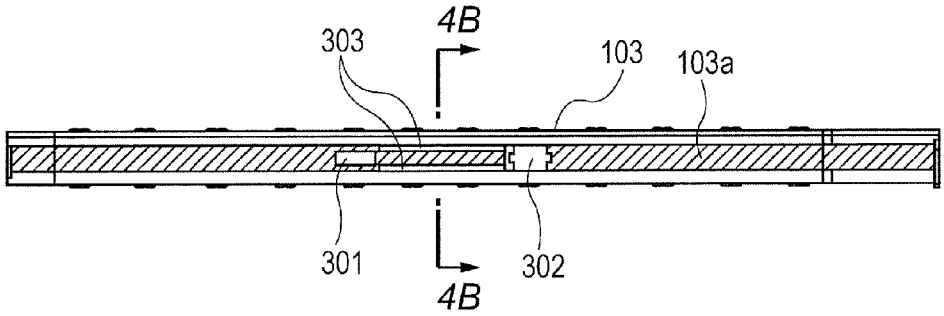
FIG. 4A is a front view showing a heater holder of the fixing apparatus according to the first embodiment as viewed from the side of a heater receiving surface.
Figure 4B:
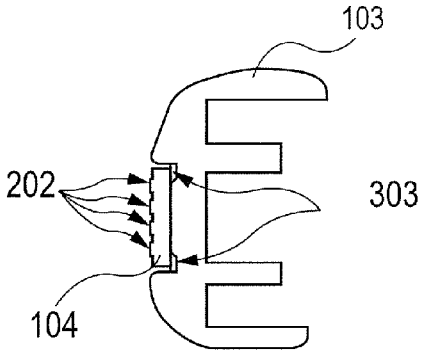
FIG. 4B is an enlarged sectional view of the heater holder taken along line 4B-4B in FIG. 4A.
Figure 4C:
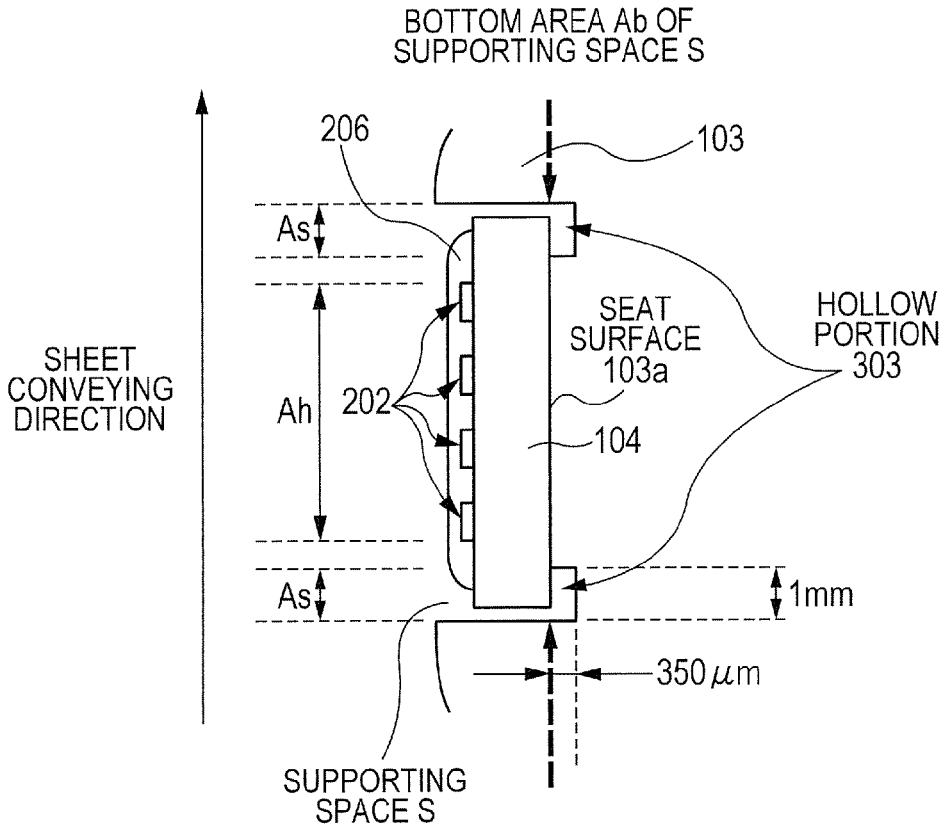
FIG. 4C is an enlarged view of a resistive heating member layer in FIG. 4A.

FIG. 4A is a front view showing the heater holder 103 as viewed from the side of a heater seat surface, FIG. 4B is an enlarged sectional view of the heater holder taken along line 4B-4B in FIG. 4A, and FIG. 4C is an enlarged view of the resistive heating member layer 202 in FIG. 4B.

The heater holder 103 is provided with a supporting space S to be fitted with the heater 104, and a seat surface (i.e., heater receiving surface: the area shown by hatched lines in FIG. 4A) 103*a* adapted to hold the heater 104 is provided in a bottom area Ab of the supporting space S. The heater receiving surface 103*a* is provided with a hole portion (through hole) 301 used to dispose a temperature-measuring element, such as a thermistor, adapted to measure the temperature of the heater 104. Furthermore, the heater receiving surface 103*a* is provided with a hole portion (through hole) 302 used to dispose a protective element, such as a thermoswitch or thermal fuse, adapted to cut off power supply to the heater 104 when the heater becomes abnormally hot. In this way, the resin holder 103 adapted to hold the heater is provided with the supporting space S to be fitted with the heater, and the bottom area Ab (seat surface 103*a*) of the supporting space S is provided with another hole portion (a through hole) 301.

Furthermore, at an upstream end and a downstream end in the recording material conveyance direction on the heater receiving surface 103*a*, recessed spot facings (hollow portions) 303 are provided along the longitudinal direction orthogonal to the recording material conveyance direction in an area other than the two hole portions 301 and 302, i.e., between the two hole portions 301 and 302. The depth of the spot facings (hollow portions) 303 is approximately 350 μm and the width (area As) is set to be approximately 1 mm so as to avoid an area Ah in which the resistive heating member layer 202 on the front surface of the substrate 201 of the heater 104 is installed. In this way, in the bottom area Ab, one or more the hollow portions 303 recessed from the bottom area Ab are provided at opposite ends (both ends) in the short direction of the holder 103 and at a location or locations in which the through holes 301 (302) do not exist in the longitudinal direction of the holder 103. In this case, plural hole portions (301 and 302) are provided in the longitudinal direction of the holder and the hollow portions 303 are provided between adjacent hole portions 301 and 302. In the longitudinal direction, the bottom area has the first area in which the hollow portion 303 exist, and the second area in which the hollow portions 303 do not exist.

The hollow portion (spot facing) 303, which is a space, functions as a heat insulating layer. Therefore, in a short direction of the heater (or sheet conveying direction), if an area As of the spot facing 303 overlaps the area Ah in which the resistive heating member layer 202 on the front surface of the substrate 201 of the heater 104 is installed, that part of the heater 104 which overlaps the area As is prone to becoming hotter than the other part. As a result, in the longitudinal direction of the heater, there is a difference in heater temperature between the area with a hollow portion and the area without a hollow portion.

However, in the present example, as described above, in the short direction of the heater, the hollow portion 303 is placed such that the area As of the hollow portion 303 does not overlap the area Ah in which the resistive heating member layer 202 of the heater is installed. Consequently, fixability is less prone to becoming irregular under the influence of temperature irregularities in the longitudinal direction of the heater.

7) Comparative Experiment

A comparative experiment was conducted using the fixing apparatus B according to the present embodiment and a fixing apparatus according to a comparative example. Except that the spot facing was not provided on the heater holder 103, the fixing apparatus according to the comparative example had the same configuration as the fixing apparatus B according to the present embodiment.

In the fixing apparatus B according to the present embodiment and the fixing apparatus according to the comparative example, it was assumed that the temperature became uncontrollable due to a failure of the temperature control circuit after the heater 104 was turned on. In the failed state, the heater 104, which continues to be supplied with power, becomes very hot, and consequently the heater receiving surface 103*a* of the heater holder 103, in direct contact with the heater 104, becomes soft. In particular, near the hole portion 301 in which a temperature-measuring element (temperature detection element) is disposed and near the hole portion 302 in which a protective element is disposed, the heater receiving surface 103*a* is narrow in width. Moreover, there is a gap (air layer) between the hole portion 301 (302) and temperature-measuring element (protective element). This results in heat concentration, increasing the amount and speed of deformation due to softening.

In the fixing apparatus, since the heater temperature is high and a large pressing force is applied to the heater holder 103, the hole portion 301 in which the temperature-measuring element is disposed and the hole portion 302 in which the protective element is disposed are subjected to larger amounts and speeds of deformation in the direction of the pressing force of the heater holder 103 than the other parts. That is, the difference in the amount of deformation in the direction of the pressing force between the hole portions 301 and 302 of the heater holder 103 and the area other than the hole portions 301 and 302 increases with time, and consequently a shearing force in the direction of the pressing force is applied to that the part of the heater that faces locations of the hole portions 301 and 302. Consequently, there was an event in which heater cracks occurred (the heater developed cracks before the protective element came into operation) even though the protective element operated, cutting off power supply to the heater 104.

On the other hand, with the heater holder 103 according to the present embodiment, between the hole portion 301 and hole portion 302 in the heater receiving surface 103*a*, the recessed spot facing 303 is provided at the upstream end and downstream end in the recording material conveyance direction. Consequently, by bringing the speed of deformation between the hole portion 301 and hole portion 302 close to the speed of deformation in the hole portions, irregularities in the amount-of-deformation slope in the longitudinal direction of the heater holder 103 can be leveled out even though the amount of deformation of the heater holder 103 increases. Thus, the shearing force applied in the direction of the pressing force was reduced in that part of the heater which faced the locations of the hole portions 301 and 302. This enabled delaying the initiation of heater cracks. If the time allowed before the heater develops cracks is increased, the protective element can come into operation during the allowed time, stopping the power supply to the heater and thereby preventing heater cracks.

It is important that the spot facing 303 is provided at both (or either one of) the upstream end and downstream end of the bottom area Ab in the recording material conveyance direction.

Figure 5:
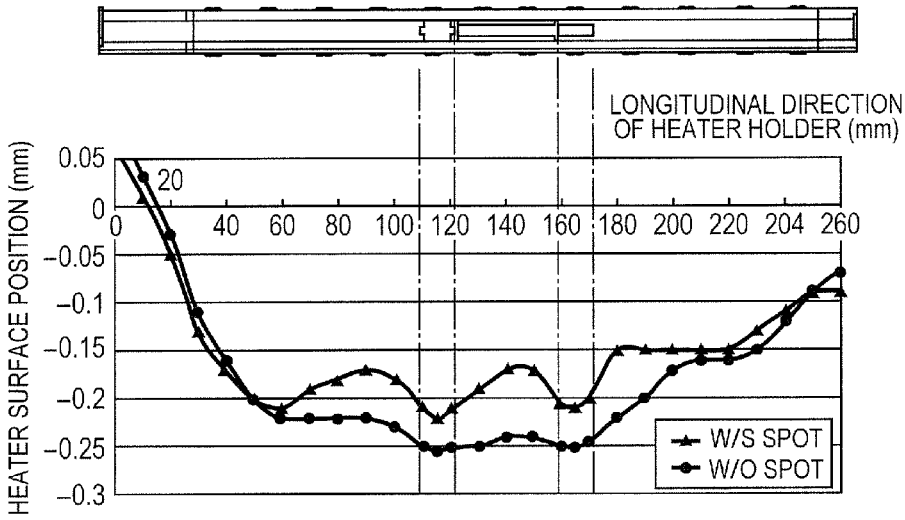
FIG. 5 is a graph showing an amount of sinking of the heater holder after 6.5 seconds from the start of runaway.

For the purpose of the experiment, the protective element was set not to come into operation, a failure state of the temperature control circuit was created, and power supply was stopped 6.5 seconds after being started. At this time, amounts of deformation on a surface of the heater 104 (the front surface of the substrate 201) in contact with the heater holder 103 were plotted and results are shown in FIG. 5. It can be seen that there is a difference between the configuration with spot facing and the configuration without spot facing in deformation profiles in and near the two hole portions. It can be seen that in the case of the heater holder without the spot facing, changes in the amount-of-deformation slope of the two hole portions are very large, meaning that the heater 104 was subjected to a very strong bending force. On the other hand, in the case of the spot-faced heater holder according to the present embodiment, although the amounts of deformation of the two hole portions are large, changes in the amount-of-deformation slope of the hole portions are small, meaning that stress concentration was avoided. Consequently, the time left until the heater 104 developed heater cracks was able to be extended by 4 to 5 seconds.

By providing the spot facing 303 on the heater receiving surface 103*a* of the heater holder 103 as described above, even if the heater 104 becomes uncontrollable, the amount of longitudinal deformation of the heater holder 103 can be leveled out, preventing local stress concentration on the heater.

As described above, in usual printing, fixability is hardly affected, and even if the temperature control circuit fails, the time left until heater cracks occur can be extended.

Second Embodiment

Another example of the fixing apparatus B will be described. Except that the heater holder 103 is configured as described below, the fixing apparatus B according to the present embodiment has the same configuration as the fixing apparatus B according to the first embodiment.

Figure 6A:
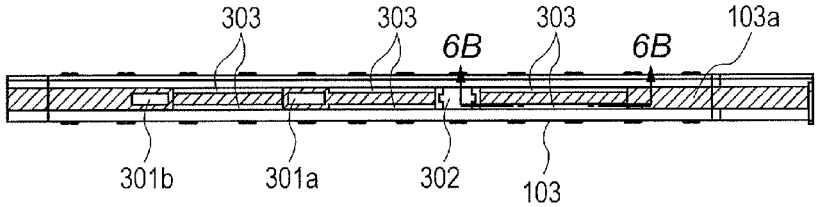
FIG. 6A is a front view showing a heater holder of a fixing apparatus according to a second embodiment as viewed from the side of a heater receiving surface.
Figure 6B:
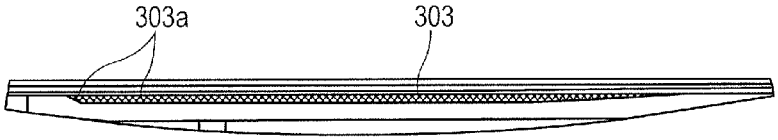
FIG. 6B is an enlarged sectional view of the heater holder taken along line 6B-6B in FIG. 6A.

FIG. 6A is a front view of the heater holder 103 as viewed from the side of the heater receiving surface 103*a* and FIG. 6B is an enlarged sectional view of the heater holder 103 taken along line 6B-6B in FIG. 6A.

The heater holder 103 has two or more hole portions in the heater receiving surface 103*a*. That is, there are two hole portions 301*a* and 301*b* for use to dispose two temperature-measuring elements and a hole portion 302 for use to dispose a protective element. The hole portion 301*b* is used to dispose a temperature-measuring element adapted to detect the temperature of that area (non-paper feed area) of the heater 104 through which small-size sheets narrower in width than large-size sheets do not pass when the small-size sheets are passed continuously through (introduced into) the fixing nip N. The hole portion 301*a* is used to dispose a temperature-measuring element adapted to detect the temperature of that area (paper feed area) of the heater 104 through which sheets always pass regardless of whether the sheets are small size or large size sheets.

At the upstream end and downstream end in the recording material conveyance direction on the heater receiving surface 103*a* (the area shown by hatched lines in FIG. 6A), recessed spot facing 303 is provided along the longitudinal direction orthogonal to the recording material conveyance direction in an area other than the three hole portions. The recessed spot facing 303 is provided between the hole portions 301*a* and 301*b*, between the hole portions 301*a* and 302, and outside the hole portion 302. Since the recessed spot facing 303 is provided outside the hole portion 302 as well as between the hole portions 301*a* and 301*b* and between the hole portions 301*a* and 302, the speed of longitudinal deformation of the heater holder 103 can be further leveled out, thereby leveling out the amount of longitudinal deformation. Although in the present embodiment, the spot facing 303 is provided at both the upstream end and downstream end in the recording material conveyance direction on the heater receiving surface 103*a*, the spot facing 303 may be provided at either one of the upstream end and downstream end in the recording material conveyance direction on the heater receiving surface 103*a*.

The depth of the spot facing 303 is approximately 0 to 400 μm as shown in FIG. 6B. Also, a tapered portion 303*a* may be provided in the spot facing 303 along the longitudinal direction of the holder to adjust the thickness of the air layer. The width of the spot facing 303 is set to be approximately 1 mm so as to avoid overlapping the area of the resistive heating member layer 202 on the front surface of the substrate 201 of the heater 104.

Other Embodiments

The depth of the spot facing 303 on the heater holder 103 according to the first embodiment may be set to approximately 0 to 400 μm and provided with a tapered portion, as shown in FIG. 6B.

A single hole portion may be provided in the heater receiving surface 103*a* of the heater holder 103. In that case, on at least either one of the upstream end and downstream end in the recording material conveyance direction on the heater receiving surface 103*a*, a recessed spot facing is provided along the longitudinal direction orthogonal to the recording material conveyance direction in an area other than the hole portion. Consequently, even if the temperature control circuit fails, exposing the heater holder 103 to the heat from the heater 104, the amount of longitudinal deformation of the heater holder 103 can be leveled out, preventing local stress concentration on the heater 104. The depth of the spot facing may be set to approximately 0 to 400 μm and provided with a tapered portion, as shown in FIG. 6B.

The fixing apparatuses according to the first and second embodiments are not limited to use as apparatuses which heat-fix an unfixed toner image on a recording material. The fixing apparatuses can also be used, for example, as apparatuses which provisionally fix an unfixed toner image on a recording material by heating or as apparatuses which provide gloss to a surface of a toner image by reheating the toner image already heat-fixed on a recording material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-285621, filed Dec. 27, 2011, which is hereby incorporated by reference herein in its entirety.

What is claimed is:

1. An image heating apparatus for heating an image formed on a recording material, comprising:

an endless belt;

a heater configured to contact an inner surface of the endless belt;

a holder made of resin and configured to hold the heater, the holder forming a supporting space in which the heater is engaged, where a heater receiving surface of the holder at a bottom area of the supporting space has formed therein one or more through holes; and a back-up member configured to form a nip together with the heater to pinch and convey the recording material through the endless belt, wherein the heater receiving surface includes one or more recessed hollow portions forming recessed portions of the bottom area, at both ends in a short direction of the holder, the hollow portions being located at a different position in a longitudinal direction of the holder from the one or more through holes.

2. An image heating apparatus according to claim 1, wherein in a case where a plurality of the through holes are formed in the longitudinal direction of the holder, a part of or all of the one or more hollow portions are provided between adjacent through holes of the plurality of the through holes.

3. An image heating apparatus according to claim 2, wherein in the longitudinal direction of the holder, the bottom area has a first area including the one or more hollow portions, and a second area not including the one or more hollow portions do not exist, each of both sides of the first area includes the second area.

4. An image heating apparatus according to claim 1, further comprising a temperature detection element configured to detect the temperature of the heater and inserted in the one or more of the through holes.

5. An image heating apparatus according to claim 1, further comprising a protective element inserted in the one or more through holes, wherein the protective element is configured to operate to cut off power supply to the heater in a case where the heater heats up abnormally.

6. An image heating apparatus according to claim 1, wherein a part of the one or more hollow portions includes a tapered portion along the longitudinal direction of the holder.

* * * * *